US009003830B2

(12) United States Patent
Colella

(10) Patent No.: US 9,003,830 B2
(45) Date of Patent: Apr. 14, 2015

(54) PLUG EARRING

(71) Applicant: Jamie Lynne Colella, Carol Stream, IL (US)

(72) Inventor: Jamie Lynne Colella, Carol Stream, IL (US)

( * ) Notice: Subject to any disclaimer, the term of this patent is extended or adjusted under 35 U.S.C. 154(b) by 0 days.

(21) Appl. No.: 13/890,959

(22) Filed: May 9, 2013

(65) Prior Publication Data

US 2013/0263626 A1 Oct. 10, 2013

Related U.S. Application Data

(60) Provisional application No. 61/728,139, filed on Nov. 19, 2012.

(51) Int. Cl.
*A44C 7/00* (2006.01)

(52) U.S. Cl.
CPC . *A44C 7/00* (2013.01); *A44C 7/003* (2013.01); *Y10S 63/90* (2013.01)

(58) Field of Classification Search
CPC ..... A44C 7/00; A44C 7/002; A44C 7/003
USPC ..... 63/35, 12
See application file for complete search history.

(56) References Cited

U.S. PATENT DOCUMENTS

| | | | | | |
|---|---|---|---|---|---|
| 119,530 | A * | 10/1871 | Northup | 63/13 |
| 161,853 | A * | 4/1875 | Baker | 63/13 |
| D326,066 | S * | 5/1992 | Sprague | D11/41 |
| 5,456,094 | A * | 10/1995 | Greenwald | 63/12 |
| 5,743,113 | A * | 4/1998 | Kogen | 63/12 |
| 6,167,725 | B1 * | 1/2001 | Siekierski | 63/12 |
| 7,617,576 | B2 * | 11/2009 | Tanio | 24/705 |
| 2006/0005577 | A1 * | 1/2006 | Stuart et al. | 63/12 |
| 2006/0005578 | A1 * | 1/2006 | Tortoli | 63/35 |
| 2007/0022779 | A1 * | 2/2007 | Christians | 63/35 |
| 2013/0110149 | A1 * | 5/2013 | Schomburg | 606/188 |

OTHER PUBLICATIONS

Facebook post by Omerica Organic, dated Aug. 31, 2012, announcing the sale of Earring plugs for posts.*
Omerica Organic Earring plugs for posts sale page.*
Omerica Organic "how to use" close up.*

* cited by examiner

*Primary Examiner* — Emily Morgan
(74) *Attorney, Agent, or Firm* — Erickson Law Group, PC

(57) ABSTRACT

A plug earring having a main body. The main body having a front surface, an ear contact peripheral surface, and a friction element. The ear contact peripheral surface is adjacent the front surface. An opening in the front surface providing communication to the friction element for receiving the post of another earring.

19 Claims, 8 Drawing Sheets

PLUG EARRING

This application claims the benefit of U.S. Patent Application No. 61/728,139, which names Jamie Lynne Colella as inventor, herein incorporated by reference in its entirety.

FIELD OF THE INVENTION

The invention relates to elements worn on, in, or about a human ear and more specifically to earrings.

BACKGROUND OF THE INVENTION

Ear piercing is a common practice to allow jewelry and other decorative matter to be worn on or about a human ear. An ear piercing involves making a hole through one's earlobe or another spot on one's ear in order to allow a post of a piece of jewelry to extend there in or there through to effectively mount the jewelry to one's ear. The post of jewelry can generally extend through one's ear and be secured by attaching a backing element to the post on the rear side of one's ear. Other securing methods known in the art may also be used.

Some people have sought to enlarge the opening provided by traditional ear piercing. The enlargement is sometimes known as stretching in the field of body piercing. The enlargement or stretching in an earlobe piercing is generally achieved by inserting progressively larger objects, in small increments, over time into the earlobe piercing to expand the opening. Some enlarged earlobe openings can reach sizes in the range of 4 mm to 16 mm or more.

When openings are enlarged, traditional ear jewelry having a posts sized for traditional sized ear piercings will no longer be wearable because the enlarged opening will be too big to hold the relatively small diameter post of traditional earlobe wear.

The present inventor recognized the need for ear wear that enables persons with gauged, stretched, or enlarged openings in their ears to wear conventional earrings, which have conventional sized posts.

SUMMARY OF THE INVENTION

A plug earring is disclosed comprising a main body having a front face, a back face, and a circumferential surface connecting the front face to the back face. At least a portion of the circumferential surface is configured to engage human skin in a piercing aperture of a human ear. The piercing aperture may be of a size enlarged from a traditional ear piercing.

The plug earring has a first hole intersecting the front face and extending into the main body. It further has a second hole concentric with the first hole. The second hole is larger than the first hole. The second hole is spaced from the front face. The first hole is in communication with the second hole. The plug earring has a friction element positioned within the second hole and configured to frictionally secure the traditional post of an earring against movement in at least one direction when the post is inserted through the first hole, into the second hole, and into the friction element.

Numerous other advantages and features of the present invention will become readily apparent from the following detailed description of the invention and the embodiments thereof, from the claims and from the accompanying drawings.

DETAILED DESCRIPTION

Figure 1:
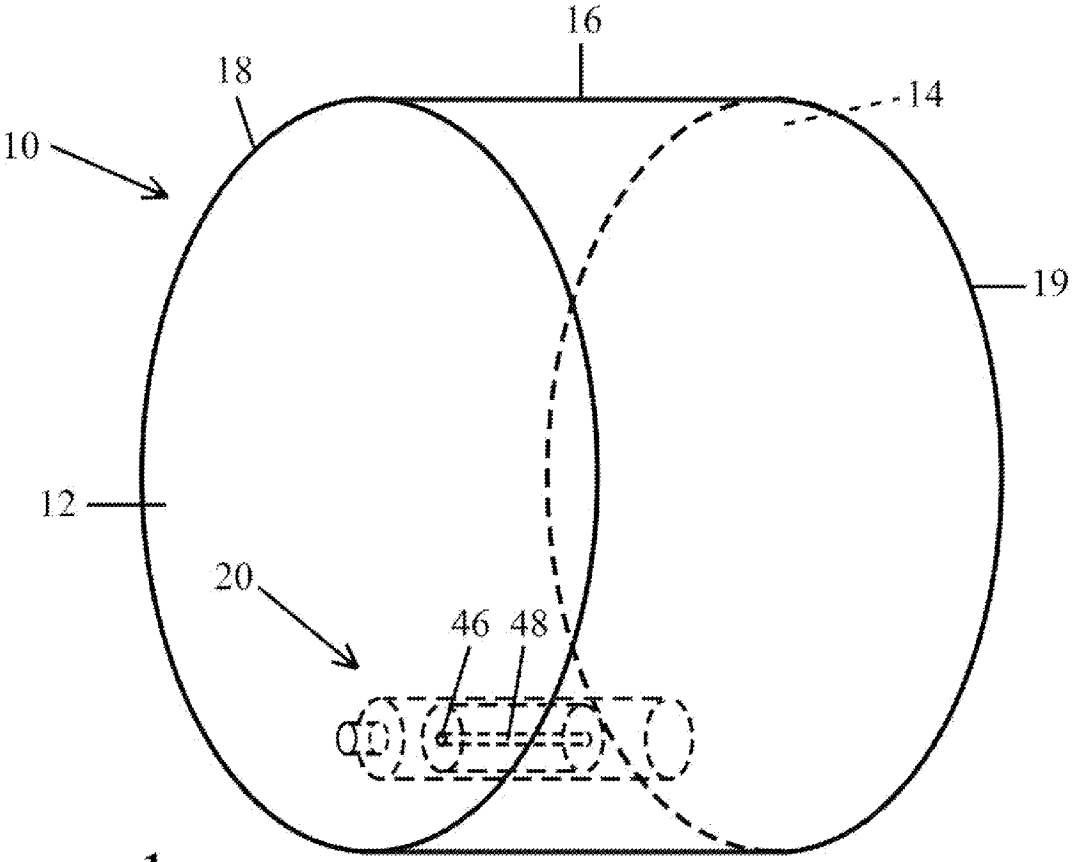
FIG. 1 is a perspective view of an embodiment of a plug earring of the invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 shows an embodiment of a plug earring of the invention. The plug earring has a main body 10 that is generally cylindrical. The main body 10 comprises a front face 12 that is parallel and spaced a part from a rear face 14. The front face and the rear face are connected by a peripheral or circumferential surface 16, which may be cylindrical. The length of the circumferential surface 16 between a front face 12 and the rear face 14 defines the depth (D shown in FIG. 3) of the main body 10 of the plug earring.

In some embodiments, the circumferential surface 16 is perpendicular to both the front face and the back face throughout the depth of the circumferential surface 16. The circumferential surface 16 joins with a rear face 14 at a rear edge 19. The front edge forms a generally circular shape. The intersection of the front face with the circumferential surface forms a ninety degree angle at the front edge 18. The circumferential surface 16 joins with a front edge 18 at a rear edge 19. The rear edge 19 forms a generally circular shape. The intersection of the rear face with a circumferential surface forms a ninety degree angle at the rear edge 19. The front face 12 is flat throughout surface of the front face. The rear face 14 is flat throughout the surface of the rear face.

The main body comprises an earring post receiver 20. Earring post receiver 20 comprises a first aperture 22. The first aperture 22 opens into a first channel 24. The first aperture 22 is located on the front face 12. The first channel has an exit opening 26 where the first channel joins and is in communication with a second channel 30. In some embodiments, the second channel is concentric with the first channel. The second channel is larger than the first channel. The second channel comprises a front wall 32 which receives the exit opening 26 of the first channel. The second channel comprises a rear wall 36 opposite the front wall 32. Between the front wall 32 and the rear wall 36 the second channel 38 comprises a circumferential interior wall 39.

Figure 2:
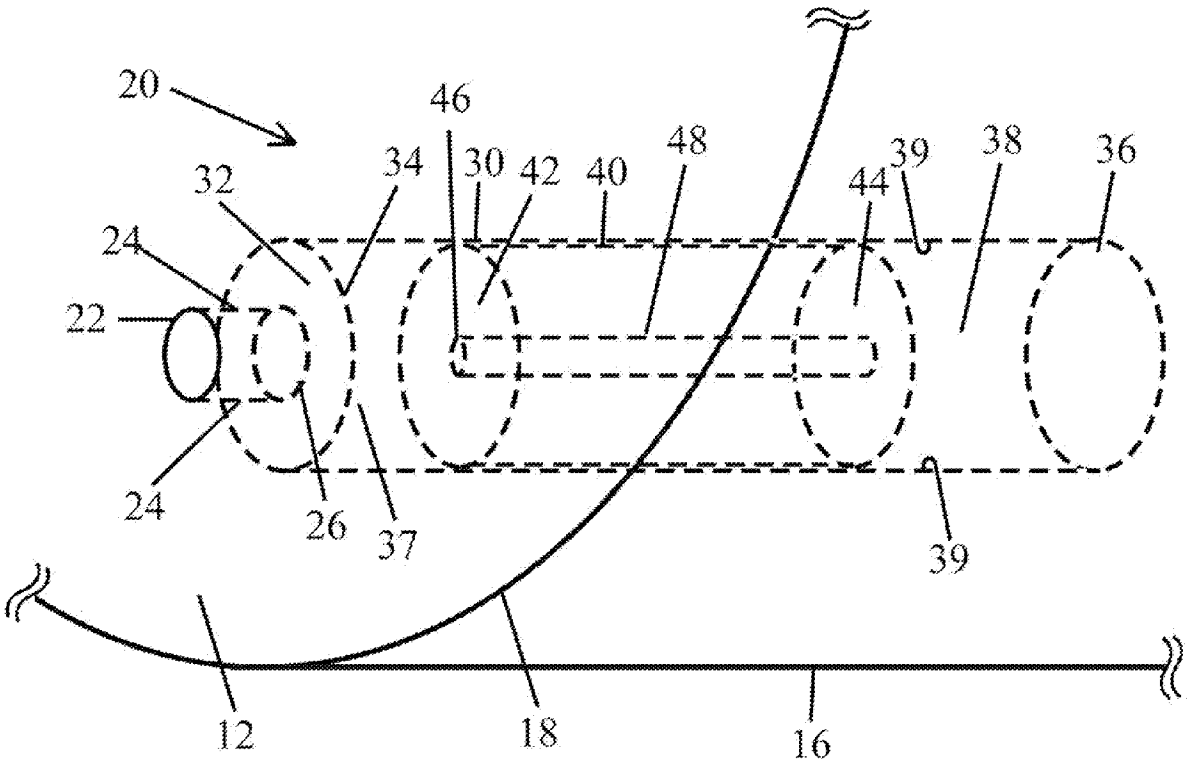
FIG. 2 is an enlarged perspective view of a portion of the plug earring taken from FIG. 1.

A friction element 40 is located within the second channel 30. The friction element 40 may comprise silicon, natural rubber, synthetic rubber, latex, polyurethane, a combination thereof, and/or other like materials. The friction element may have a cylinder shape, star-like shape, or other shape. The friction element 40 has an exterior diameter that is sized to create a friction fit against the interior wall 39 the second channel 30, so as to prevent movement of the friction element 40 relative to the second channel 30, except upon the application of a predefined friction overcoming amount of force. Therefore exterior diameter of the friction element 40 may be less than the diameter of the second channel 30 so as to create a friction fit there between. The friction element has a front face 42 and a rear face 44. There is a friction aperture 46 located in the front face 42 of the friction element. In some embodiments the friction aperture 46 is aligned and concentric with the first aperture 22. The center of the first aperture 22 may be aligned with the center of the friction aperture 46. The friction aperture 46 opens into a friction channel 48 within the friction element. The friction channel and friction aperture shown in FIG. 2 is expanded to show detail.

Figure 3:
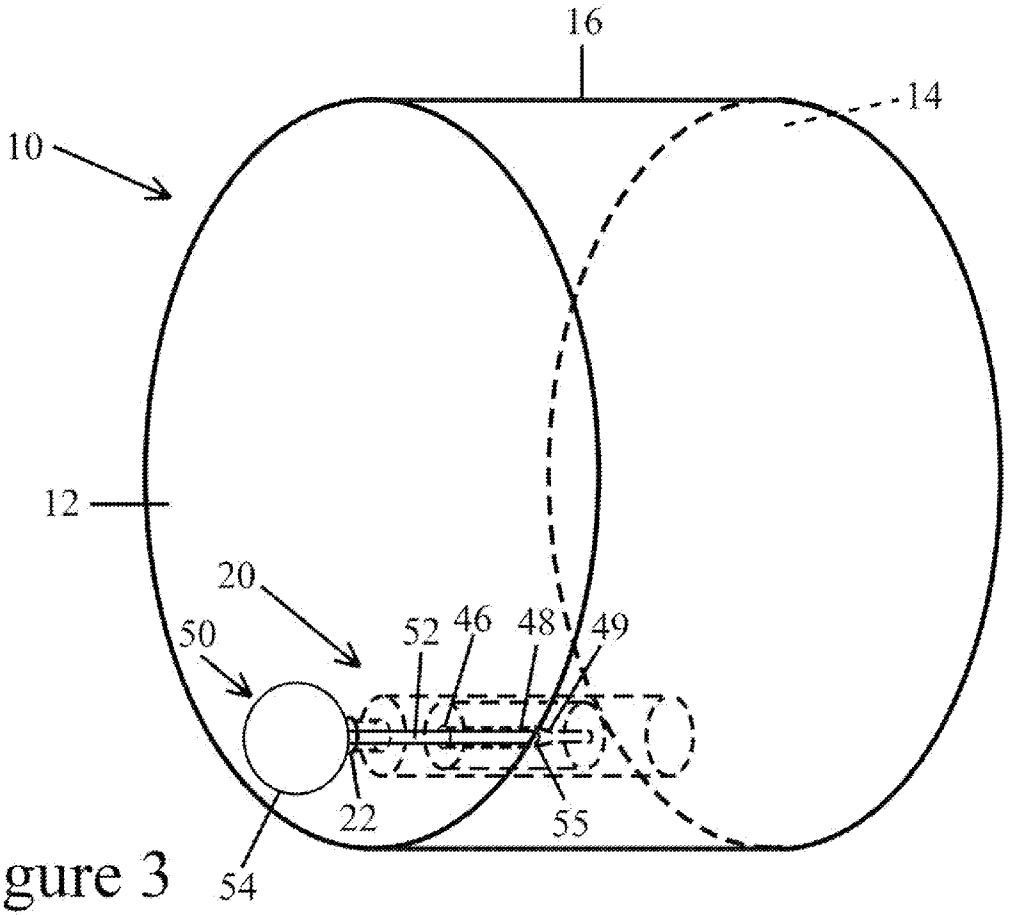
FIG. 3 is a perspective view of FIG. 1, where the plug earring is receiving a traditional post of a traditional earring.

The friction aperture and friction channel are configured to receive the post 52 of an conventional earring 50 as shown in FIG. 3. The friction channel 48 may be biased to collapse on itself when not receiving a post 52 of earring as shown in FIG. 1. When the post is inserted through the first aperture 22 into the second channel and into the friction aperture 46, the post 52 causes the friction aperture 46 and the friction channel 48 to expand to receive the post therein. The interior walls of the friction channel 48 grip the post 52, according to the bias toward the collapsed state, to prevent the post from moving further in or out of the friction channel unless the predefined friction overcoming amount of force is applied to overcome the friction of the friction channel.

As can be seen in FIG. 3, the friction channel is expanded by the post 52 throughout a portion of the friction channel where the post 52 is inserted. Immediately adjacent the end 55 of the post 52, friction channel 48 collapses and a collapsing area 49 is caused by the biasing of the friction channel to its collapsed state. Extending rearward from the collapsing area 49 the friction channel maintains its collapsed state. In some embodiments the collapse state of the friction channel does not require that the walls of the friction channel be collapsed upon itself but rather could include that the diameter of the friction channel is reduced from that of the expanded state.

The earring 50 shown in FIG. 3, has a bulb end 54 connected to the post 52. However any other earring having a post may be received within the post receiver 20. Any earring having a post that is generally received through a traditional piercing in the wearer's ear may be received within the post receiver 20.

In some embodiments, the depth D along the circumferential surface 16 is in the range of 9 millimeters (mm) to 14 mm. The diameter of each of the front face 12 and the rear face 14 is in the range of 4 mm to 10.14 centimeters (cm). The diameter of the first aperture 22 and the first channel is about 1 mm. The diameter of the second channel is about 3 mm. The depth of the second channel from the rear face 14 toward the front face 12 is in the range of 5 mm to 12 mm. The depth of the first channel from the front surface until it meets the second channel is in the range of 2 mm to 4 mm.

In some embodiments, the axes of the first channel 24 and the second channel 30 are the same. The axis of the first channel and the axis of the second channel are each parallel to the circumferential surface 16 and perpendicular to the front face 12. In some embodiments the axis of the first and second channels are not perpendicular to the front face but intersect the front face at an obtuse angle to the front face.

The first aperture 22 and correspondingly the earring posts receiver 20 may be located anywhere on the front face 12 and within the body, respectively. As shown in FIG. 1, first aperture 22 is located in a non-center location of the front face 12. In some embodiments, the first aperture 22 is located in the center of the front face.

In some embodiments, the first channel 24, the second channel 30, the first aperture 22, and the friction element 40, may each comprise shapes other than cylindrical, such as shapes having a cross-section of rectangular, oblong, irregular, or other configuration. In some embodiments, the friction element occupies only a portion of the second channel leaving a rear gap 38 and a front gap 37 in the second channel. In some embodiments, the friction element occupies the entire length and/or area of the second channel. In some embodiments, the friction element contacts the front wall 32 leaving only a rear gap 38. In some embodiments, the friction element contacts a rear wall 36 leaving only a front gap 37.

Figure 4:
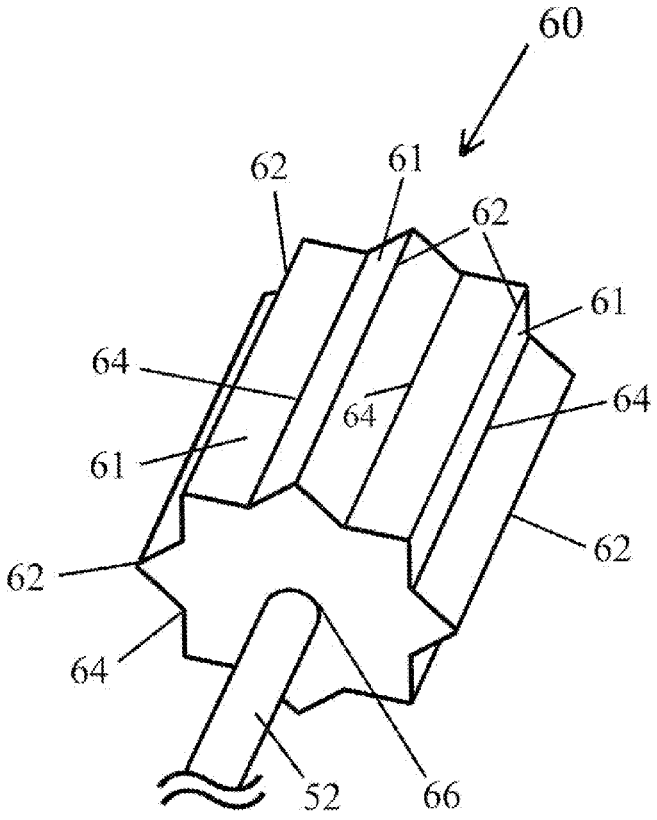
FIG. 4 is a perspective view of a friction element engaging with a post.

FIG. 4 shows a alternative embodiment of a friction element 60. The friction element 60 may be utilized in place of friction element 40 within the second channel 30. The friction element 60 has a generally star shape cross-section. The exterior diameter of the friction element 60 as a plurality of protruding wedges 61 that form peaks 62 and valleys 64 between the peaks 62. The peaks and wedges engage with the interior wall 39 of the second channel to create a friction fit there between. The friction element 60 as a friction aperture 66 and a friction channel that is configured and operates the same as the friction aperture 46 and friction channel 48 of the friction element 40.

In some embodiments, the second channel 30 does not intersect the rear face 14. In some embodiments, the second channel 30 extends to and intersects with the rear face 14 of the main body 10, so that a rear aperture is formed in the rear face 14. This arrangement may be preferable for ease of manufacturing.

A method of manufacturing a plug earring is now disclosed, comprising forming, by drilling, a first channel having a first diameter to a first depth from either the front face or the rear face of the body; forming, by drilling, a second channel having a second diameter to a second depth, beginning from the rear face; and inserting a friction element into the second channel where the friction element is sized to be frictionally secured within the second channel. Optionally, closing off and sealing a portion of the second channel adjacent the rear face. The first and the second channel may be formed in any order. The rear aperture may be closed off by inserting a plug therein. A plug maybe made of silicon, natural rubber, synthetic rubber, latex, polyurethane, a combination thereof, and/or other like materials or it may be made out of any material to which matches the material of the body 10. Therefore if the body is acrylic, the plug will also be acrylic. If the body is steel or another metal, the plug will correspondingly be steel or another metal and the plug and the rear aperture extending into the second channel will have corresponding threads for screwing the plug into the rear aperture. The rear aperture may also be closed off by inserting a liquid rubber that, after a period of time, solidifies to close the rear opening.

In some embodiments, the rear aperture is not closed off. Instead the aperture is open to the rear face to allow a post to extend completely through the body, and for a locking element, such as a nut, to be placed on the post adjacent the rear face. If the locking element is utilized a friction element may not be needed or utilized within the second channel.

In some embodiments, only one channel exists. The channel intersects with the front face 12 and forms an aperture therein. The channel also contains a friction element. In this arrangement a a second channel is not utilized. Instead a single uniformly sized channel extends from the front face a predefined depth into the body.

Figure 5:
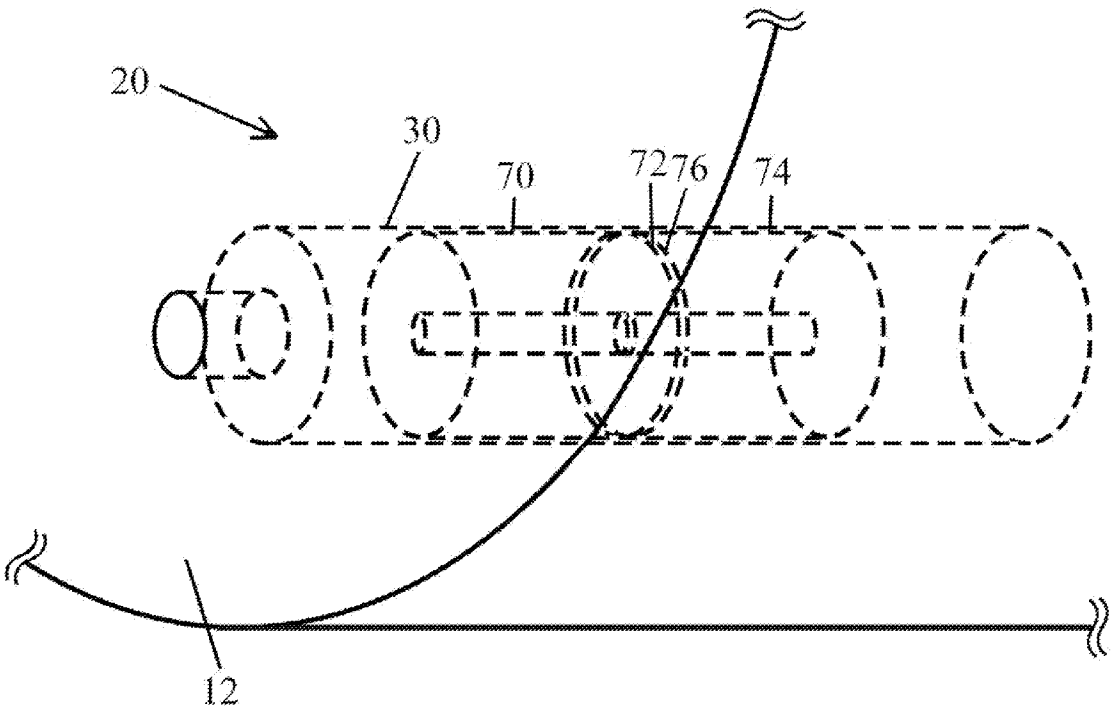
FIG. 5 is an enlarged perspective view of an embodiment of the invention including multiple friction elements.

FIG. 5 shows an embodiment having multiple friction elements 70, 72 abutted against one another within the second channel 30. Friction elements 70, 72 shown in FIG. 5 are identical to friction element 40, however other embodiments of friction elements may be abutted against one another within the second channel. As shown in FIG. 5, a rear end 72 of the first friction element is abutted against a front 76 of the second friction element 74. While FIG. 5 shows two friction elements within the second channel, any number of friction elements, such as three, four, five, six, or more friction elements may be used within the channel and may or may not be directly abutted against one another. In some embodiments, the friction elements may be spaced apart from one another within the channel.

Figure 6:
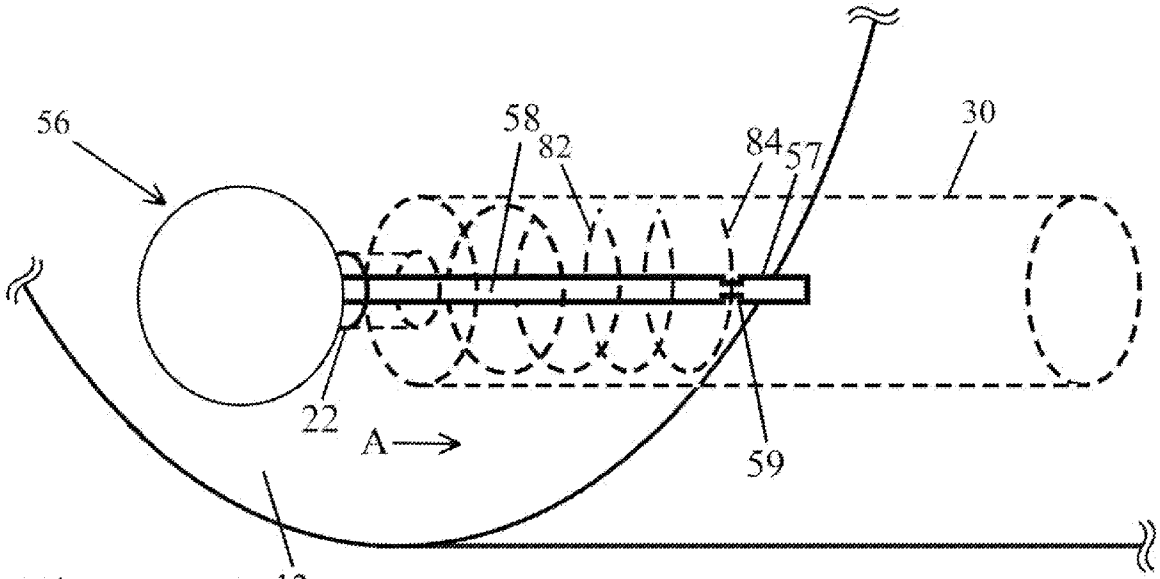
FIG. 6 is an enlarged perspective view of a plug earring having an alternative embodiment earring post receiver with a spring element.
Figure 7:
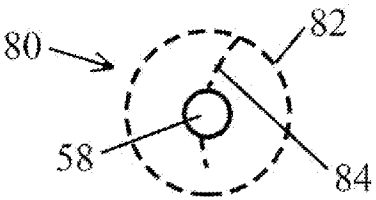
FIG. 7 is an end view of the post and spring element of FIG. 6.

FIG. 6 shows an alternative embodiment of the earring post receiver which is identical to earring post receiver 20 except that the earring post receiver of FIG. 6 does not utilize the friction element 40. Instead a spring element 80 is contained within the second channel 30. The spring element 80 has an encircling spring portion 82 and an engagement portion 84. The engagement portion, as shown in FIG. 7, extends inward from the circumference of the encircling spring portion 82 to engage with an engagement recess 59 of an earring post 58 of an earring 56. The post 58 is similar to post 52 except that post 58 has an engagement recess 59. The engagement recessed 59 has a circumference that is less than the circumference of the remaining portions of the post 58.

When the post is pushed a sufficient depth into the second channel 30 it comes in contact with the engagement portion 84 of the spring element. With sufficient force applied in the direction A as shown in FIG. 6 the post 58 will force the engagement element upward and the engagement element will ride along an end portion 57 until the engagement portion 84 of the spring element reaches the recess 59. When the engagement portion 84 falls into the recess 59, spring tension on the engagement portion will secure the post from lateral movement in the direction A or the direction opposite A, unless a sufficient amount of force is applied to overcome the spring tension biasing the engagement portion 84 into the engagement recessed 59. The encircling spring portion 82 may be sized to create a friction engagement with the interior wall of the second channel to prevent movement relative to the second channel. In some embodiments, the spring element has a sufficient length to engage both a front wall and a rear wall of the second channel to be secured there between against movement relative to the second channel.

Figure 9:
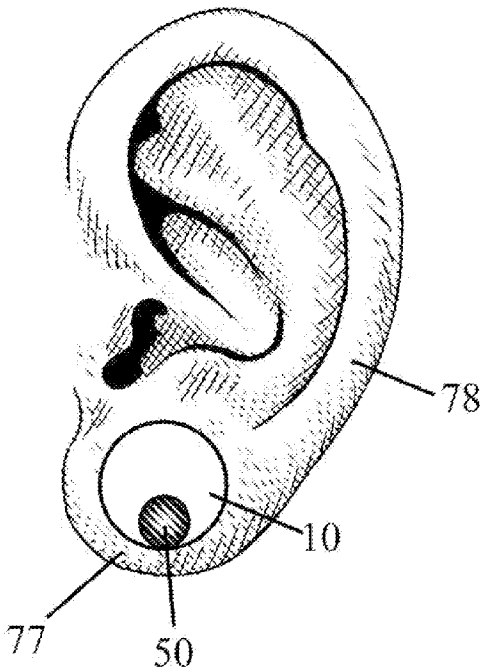
FIG. 9 is a front view of the plug earring of FIG. 1 shown in a wearer's earlobe, where the plug earring has received a traditional earring having a traditionally sized post.
Figure 8:
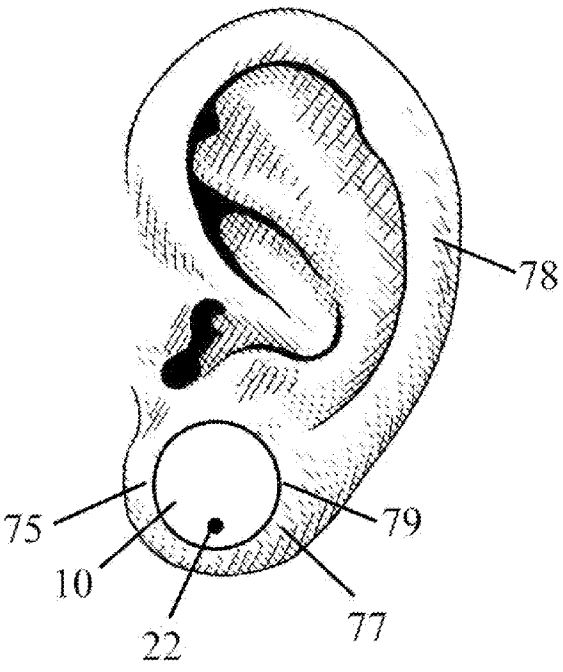
FIG. 8 is a front view of the plug earring of FIG. 1 shown in a wearer's earlobe.

FIGS. 8 and 9 show the plug earring within an enlarged opening 79 in an earlobe 77 of a wearer's ear 78. The opening 79 in the earlobe has been an enlarged beyond the common small ear piercing. The opening 79 is a sufficient size to receive the main body 10 therein. The circumferential surface 16 is engaged with the interior diameter of the opening 79 of the wearer's earlobe 77. In FIG. 8, an earring having an earring post has not yet been inserted into the first aperture 22. FIG. 9 shows a view of earring 50 having an earring post inserted into the first aperture 22, into the first channel, into the second channel, and into the friction element of the plug earring of the invention. The plug earring of the invention allows a user having an enlarged opening in his or her earlobe to wear earrings having a post of the size traditionally used with traditionally sized earlobe piercing openings.

Figure 10:
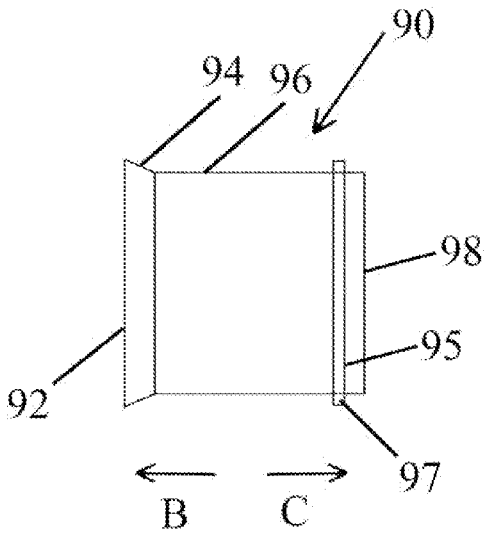
FIG. 10 is a side view of a second embodiment plug earring of the invention.

FIGS. 10 through 13 show alternative embodiments of the shape of the main body of the plug earring. Each of the alternative embodiments has the earring post receiver 20. FIG. 10 shows a second embodiment main body 90 which has a front face 92, a rear face 98, a circumferential surface 96, a front lip 94, and a rear recess 95. The front lip 94 has a circumference that increases between its intersection with a circumferential surface 96 and the front face 92. The front lip 94 is configured to prevent the plug earring from falling through the opening 79 in the earlobe and out from behind the earlobe. The front lip 94 will contact a front surface 75 of the earlobe adjacent the opening 79 and prevent the plug earring from falling out of the ear the rearward direction (direction C of FIG. 10). Similarly, a rear recess 95 and O-ring 97 combination is configured to prevent the plug earring from falling forward (direction B of FIG. 10) out of a wearer's earlobe. The recess 95 is located on circumferential surface 96 adjacent the intersection of the circumferential surface 96 and the rear face 98. In use, the plug earring 90 will first have the O-ring 97 removed from the recess 95, then the user will insert the plug earring, rear face 98 first into the opening 79, until the front lip 94 reaches the front surface 75 of the earlobe. A rear portion of the plug earring including the recess 95 will extend beyond the back surface of the users earlobe so that the recess will be exposed. Then the user will place the O-ring into the recess. The O-ring 97 is of a sufficient size so that a portion extends out of the recess and therefore can stop a plug earring from falling forward out of the wearer's earlobe. The front lip 94 may also be known as a front flare and the configuration of FIG. 10 may be known as a single flare body.

Figure 11:
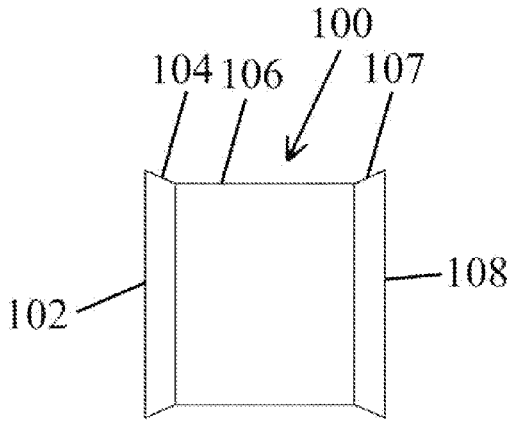
FIG. 11 is a side view of a third embodiment plug earring of the invention.

FIG. 11 shows a third embodiment of a main body 100 which has a front face 102 at a rear face 108, a circumferential surface 16, a front lip 104, and a rear lip 107. The front lip 104 has a circumference that increases between its intersection with the circumferential surface 106 and the front face 102. Similarly the rear lip 107 as a circumference that increases between its intersection with the circumferential surface 106 and the rear face 108. Both the front and rear lips 104, 107 prevent the plug earring from falling out of a wearer's ear, either out of the rear side (in direction C of FIG. 10) or the front side (in direction B of FIG. 10), respectively, of the wearer's earlobe. The plug earring is installed by stretching the opening 79 to receive either a front lip 104 or the rear lip therethrough, until either the front lip 104 or the rear lip 107 reaches the respective front surface or rear surface of the wearer's earlobe. The front lip 104 and rear lip 107 may also be known as a front flare and a rear flare respectively, and the configuration of FIG. 11 may be known as a double flare body.

Figure 12:
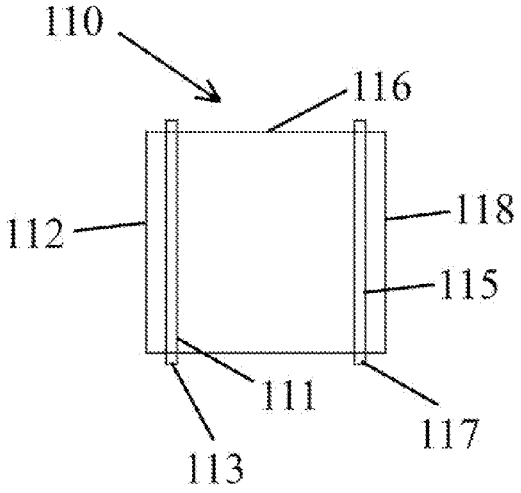
FIG. 12 is a side view of a fourth embodiment plug earring of the invention.

FIG. 12 shows a fourth embodiment of a main body 110, which has a front face 112, a rear face 118, a circumferential surface 116, a front recess 111, and a rear recess 115. The rear recess 115 and rear O-ring 117 combination is configured to prevent the plug earring from falling forward out of a wearer's earlobe. The front recess 111 and the front O-ring 113 combination is configured to prevent the plug earring from falling rearward out of a wearer's earlobe. In use, the plug earring of the main body 110 will first have either or both of the front or rear O-rings 113, 117 removed from the corresponding front or rear recess 111, 115. Then in the case of the rear o-ring removed, the user will insert the plug earring, rear face 118 first, into the opening 79 until either the front recess is adjacent the front surface of the earlobe or the rear recess is adjacent a rear surface of the earlobe or both. In the case of the front o-ring removed, the user will insert the plug earring, front surface 112, first from the rear side of the earlobe, into the opening 79 until either the front recess is adjacent the front surface of the earlobe or the rear recess is adjacent a rear surface of the earlobe or both. One or both of the O-rings 113, 117 will be placed into the corresponding recess(es) 111, 115 to prevent the plug earring from falling out of the earlobe in either the forward direction (direction B of FIG. 10) or the rearward direction (direction C of FIG. 10). Therefore the O-rings will engage or be engageable with the front and rear surfaces of the earlobe adjacent the opening 79.

Figure 13:
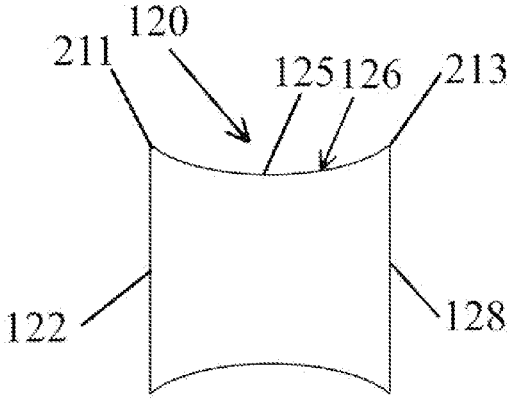
FIG. 13 is a side view of a fifth embodiment plug earring of the invention.

FIG. 13 shows a fifth embodiment of a main body 120, which has a front face 122, a rear face 128, and a circumferential surface 126. The circumferential surface 126 has a midpoint 125 located between a front edge 211 and a rear edge 213. The circumference at the midpoint 125 is the least along the length of the circumferential surface. The circumference increases in both directions from the midpoint 125 towards each of the front edge 211 and the rear edge 213. Therefore the front edge 211 and the rear edge 213 and the areas of the circumferential surface adjacent thereto will prevent the plug earring from falling out of the wearer's ear in either direction. In some embodiments, the circumference may increase at a constant rate from the midpoint to the respective front and rear edges. In some embodiments, the circumference does not increase at a constant rate from the midpoint toward the front and rear edges. The circumference may increase at a higher rate adjacent the front and rear edges than adjacent to the midpoint.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A plug earring, comprising:

a main body comprising a front face, a rear face, a second channel having a diameter, a friction element, and a circumferential surface transverse to the front face and traverse to the rear face;

the circumferential surface comprising a main surface having a diameter, a front flare, and a rear flare or o-ring, the front flare and the rear flare or o-ring extend above at least a portion of the main surface, the front flare extends about a first circumferential location along the circumferential surface adjacent to the front face, the rear flare or o-ring extends about a second circumference location along the circumferential surface adjacent the rear face;

the circumferential surface is configured to contact a perimeter of an enlarged human ear piecing opening, the front flare configured to prevent the main body from falling out of the enlarged human ear piecing opening in a rearward direction by contact between the front flare and a front portion of the wearer's ear adjacent the enlarged ear piecing opening, the rear flare or o-ring configured to prevent the main body from falling out of the enlarged ear piecing opening in a forward direction opposite of the rearward direction by contact between the rear flare or o-ring and a rear portion of the wearer's ear adjacent the enlarged ear piecing opening; and a first aperture on the front surface, the first aperture is in communication with the second channel, the friction element positioned in the second channel;

the friction element comprises a friction channel for frictionally engaging the post of another earring, the friction channel is biased to a collapsed state to grip the post of another earring when the post is inserted through the first aperture and into the friction channel of the friction element, the friction channel collapses on itself when the post of another earring is not received in the friction channel;

the second channel is not in communication with the rear face; and the diameter of the main surface is substantially greater than the diameter of the second channel.

2. The plug earring of claim 1, wherein the main body is cylindrical and the circumferential surface is a cylindrical surface.

3. The plug earring of claim 1, wherein the first aperture is located at a center of the front face, the first aperture comprises a diameter of about 1 mm.

4. The plug earring of claim 1, wherein the first aperture is located at an off-center location on the front face.

5. The plug earring of claim 1, wherein the rear flare or o-ring is a rear flare.

6. The plug earring of claim 1, wherein the circumferential surface comprises an o-ring groove adjacent the rear face, and the rear flare or o-ring is an o-ring removably receivable within the o-ring groove.

7. The plug earring of claim 1, wherein the circumferential surface is concave along at least a portion of the circumferential surface between the front face and the rear face.

8. A plug earring, comprising:

a main body comprising a front face, a rear face, a second channel having a diameter, a friction element, and a circumferential surface transverse to the front face and traverse to the rear face;

each of the front face and the rear face comprise a circular perimeter;

the circumferential surface comprising a main surface having a diameter, a front o-ring and a rear o-ring, each o-ring extending above at least a portion of the main surface, the front o-ring extends about a first circumferential location along the circumferential surface adjacent to the front face, the rear o-ring extends about a second circumference location along the circumferential surface adjacent the rear face;

the circumferential surface is configured to contact a perimeter of an enlarged human ear piecing opening, the front o-ring configured to prevent the main body from falling out of the enlarged human ear piecing opening in a rearward direction by contact between the front o-ring and a front portion of the wearer's ear adjacent the enlarged ear piecing opening, the rear o-ring configured to prevent the main body from falling out of the enlarged ear piecing opening in a forward direction opposite of the rearward direction by contact between the rear o-ring and a rear portion of the wearer's ear adjacent the enlarged ear piecing opening; and a first aperture on the front surface, the first aperture is in communication with the second channel, the friction element positioned in the second channel;

the friction element comprises a friction channel for frictionally engaging the post of another earring, the friction channel is biased to a collapsed state to grip the post of another earring when the post is inserted through the first aperture and into the friction channel of the friction element, the friction channel collapses on itself when the post of another earring is not received in the friction channel;

the second channel is not in communication with the rear face; and the diameter of the main surface is substantially greater than the diameter of the second channel.

9. The plug earring of claim 8, wherein the main body is cylindrical and the main body has a depth along the circumferential surface that is between 9 millimeters (mm) and 14 mm; the main body has a diameter that is between 4 mm and 10 centimeters, and the first aperture comprises a diameter of about 1 mm.

10. A plug earring, comprising:

a main body having a front face, a back face, and a circumferential surface between the front face and the back face;

the circumferential surface comprising a main surface having a diameter, a front flare, and a rear flare or o-ring;

each of the front flare and the rear flare or o-ring flare extends above at least a portion of the main surface, the front flare extends about a first circumferential location along the circumferential surface adjacent to the front face, the rear flare or o-ring extends about a second circumference location along the circumferential surface adjacent the rear face;

the circumferential surface is configured to contact a perimeter of an enlarged human ear piecing opening, the front flare configured to prevent the main body from falling out of the enlarged human ear piecing opening in a rearward direction by contact between the front flare and a front portion of the wearer's ear adjacent the enlarged ear piecing opening, the rear flare or o-ring configured to prevent the main body from falling out of the enlarged ear piecing opening in a forward direction opposite of the rearward direction by contact between the rear flare or o-ring and a rear portion of the wearer's ear adjacent the enlarged ear piecing opening;

a first channel intersecting the front face to form a first aperture in the front face, the first channel extending into the main body, the first channel having a diameter;

a second channel in communication with the first channel, the second channel having a diameter that is larger than the diameter of the first channel, the second channel spaced from the front face, the first channel intersecting and terminating at the second channel;

a friction element positioned within the second channel and configured to frictionally secure the post of another earring against movement in at least one direction when the post is inserted into the first and second channels and into the friction element;

the friction element comprises a friction channel for receiving the post of another earring, the friction channel is biased to a collapsed state to grip the post of another earring when the post is inserted through the first aperture and into the friction channel of the friction element, the friction channel collapses on itself when the post of another earring is not received in the friction channel;

the first channel and the second channel are not open to the rear face; and the diameter of the main surface is substantially larger than the diameter of the second channel.

11. The plug earring of claim 10, wherein the first channel is concentric with the second channel.

12. The plug earring of claim 1, wherein the first aperture comprises a diameter of about 1 mm.

13. The plug earring of claim 8, wherein the circumferential surface comprises an o-ring groove adjacent the rear face, and the rear o-ring is removably receivable within the o-ring groove.

14. The plug earring of claim 8, wherein the circumferential surface comprises a front o-ring groove and a rear o-ring groove, the front o-ring groove adjacent the front face and the rear o-ring groove adjacent the rear face, the first o-ring removably received in the front o-ring groove and the rear o-ring removably received in the rear o-ring groove.

15. The plug rearing of claim 8, comprising a first channel connecting the first aperture to the second channel; the second channel being larger than the first channel, the second channel spaced from the front face, the first channel intersecting and terminating at the second channel, the first channel is concentric with the second channel.

16. The plug earring of claim 8, wherein the first aperture is located at a center of the front face.

17. The plug earring of claim 8, wherein the first aperture is located at an off-center location on the front face.

18. The plug earring of claim 10, wherein the rear flare or o-ring is a rear flare.

19. The plug earring of claim 10, wherein the circumferential surface comprises an o-ring groove adjacent the rear face, and the rear flare or o-ring is an o-ring removably receivable within the o-ring groove.

* * * * *